US005577968A

United States Patent [19]

Pritchett

[11] Patent Number: 5,577,968

[45] Date of Patent: Nov. 26, 1996

[54] GOLF CLUBS

[76] Inventor: Ronnie S. Pritchett, 2047 Domador, San Clemente, Calif. 92672

[21] Appl. No.: 547,757

[22] Filed: Oct. 24, 1995

Related U.S. Application Data

[63] Continuation-in-part of Ser. No. 277,990, Jul. 20, 1994, abandoned.

[51] Int. Cl.[6] ..... A63B 53/02

[52] U.S. Cl. ..... 473/305; 473/314; 473/340; 473/349

[58] Field of Search ..... 273/80.1, 80.2, 273/80.3, 80.4, 80.5, 80.6, 80.7, 80.8, 80.9, 81 B, 80 R, 80 C, 167 R, 167 D, 167 G, 167 F, 169, 167 K, 77 R, 193 R; 473/305, 314, 340, 349

[56] References Cited

U.S. PATENT DOCUMENTS

| | | | |
|---|---|---|---|
| D. 223,031 | 2/1972 | Ernst | 273/167 G |
| 1,952,624 | 3/1934 | Inman | 273/167 R |
| 2,926,913 | 3/1960 | Stecher | 273/167 G |
| 3,992,015 | 11/1976 | Benson | 273/80.2 |
| 4,147,357 | 4/1979 | Strop | 273/80 C |
| 4,951,949 | 8/1990 | Kastenhuber | 273/80 C |
| 5,078,398 | 1/1992 | Reed | 273/167 G |

FOREIGN PATENT DOCUMENTS

| | | | |
|---|---|---|---|
| 2230461 | 10/1990 | United Kingdom | 273/167 R |
| 8403447 | 9/1984 | WIPO | 273/81 B |

OTHER PUBLICATIONS

"Golf Digest", magazine, 1979–Jan., p. 88, Advertisement for Tarantala Putter.

*Primary Examiner*—Sebastiano Passaniti
*Attorney, Agent, or Firm*—John Lezdey

[57] ABSTRACT

A golf club especially constructed to improve the player's control and accuracy of the golf swing by means of an inverted V-shaped member located on top of the clubhead either as part of the head or as part of the shaft.

12 Claims, 2 Drawing Sheets

GOLF CLUBS

RELATED APPLICATIONS

This application is a continuation-in-part of application Ser. No. 08/277,990 filed Jul. 20, 1994, now abandoned.

FIELD OF THE INVENTION

The present invention relates to golf clubs and more particularly to golf putters having an advantageous construction.

BACKGROUND OF THE INVENTION

It is the principal object of the present invention to construct a golf putter that will improve the putting performance of golfers. The prior art has taught a variety of head and shaft constructions and arrangements for golf putters. However, many such putters do not comply with the rules of the United States Golf Association (USGA) because they are built outside of the required specifications or they require the player to assume an illegal stance when putting. Hence, such putters cannot be used in tournaments conducted pursuant to, sponsored or sanctioned by the USGA. See Rule 2 and Appendix II USGA Re-Drafts (Sep. 11, 1981), which are incorporated herein by reference.

The construction of a putter according to the rules require that the shaft or neck or socket of a putter be fixed at any point in the head and need not remain in line with the heel. The axis of the shaft from the top to a point not more than five (5) inches (127 mm) above the sole shall diverge in the toe-heel plane from the vertical by at least ten (10) degrees in relation to the horizontal line determining the length of the head. A yoke-type of clubhead must be filled.

The length of the clubhead shall be greater than the breadth. These measurements are made on horizontal lines between the vertical projections of the extremities when the clubhead is grounded in its normal address position. The rules further permit that only for putters can furrows or runners extend into the face.

Conventional putters have a flat face which when striking the ball, especially on a long putt, causes the ball to skid. The skidding causes a loss of control of the ball since the ball can jump off the ground especially on a long putt. Skidding can amount to 20% of the distance to the hole in long putts.

U.S. Pat. No. 3,992,015 discloses a four-prong putter head having an insert. However, the head is not balanced.

The present invention seeks to solve these problems and improve the player's putting performance by providing a putter with a novel inverted V-shaped construction. This construction is in compliance with the USGA rules and provides the player with an improved balance and feel of the club and more control over the putt which results in better putting performance.

SUMMARY OF THE INVENTION

The present invention lies in the novel construction of a balanced golf putter. An inverted two pronged V-shaped member or yoke is provided on top of a standard shaped putter head with an insert or wall filling between the prongs. The member can be constructed as part of the head or, in another embodiment of the invention, as part of the shaft that attaches to the head. In yet another embodiment of the invention, the two pronged inverted V-shaped member is incorporated into any kind of golf club including any and all drivers and fairway clubs so as to be balanced as a result of the yoke being divided into three equal segments. The prongs of the V-shaped members are at a selected angle so as to reduce tendency to twist the head.

It is therefore a general object of the invention to provide a putter that overcomes the difficulties of prior putters.

It is a further object of the invention to provide a putter that improves the balance and feel of the club.

It is a further object of the invention to provide a putter that improves the player's control over a putt.

It is a further object of the invention to provide a putter that does not cause the ball to skid or jump off the ground on long putts.

It is a further object of the invention to provide a golf club for use as a driver or fairway club that improves the balance and feel of the club.

It is a still further object of the invention to provide a putter that improves the player's score without violating the rules and ethics of the game.

Other objects and advantages will become more apparent from the following detailed description of the preferred embodiments and the accompanying drawing.

BRIEF DESCRIPTION OF THE DRAWINGS

As shown in FIG. 1, a front view of a putter 10 of the invention, the shaft 11 of the golf putter 10 opens at one end into an inverted V-shaped member 12 with prongs 12*a* and 12*b*. The shaft 11 is affixed to the clubhead 13 keeping the center 14 of the shaft 11 longitudinally in line with the center 15 of the striking face 13*a*. A wall or insert 26 is provided between the prongs 12*a* and 12*b*.

As shown in FIG. 1 the clubhead is balanced by dividing the clubhead into three equal segments, toe 13*b*, center 13*c* and heel 13*d*. The segments may be 4 cm along the horizontal line as shown or 3.5 cm, 3.0 cm, etc. depending upon golfer's preference. Prong 12*a* of the V-shaped member 12 is connected at the center of the toe portion 13*b* and prong 12*b* is connected at the center of the heel portion 13*d* while the shaft 11 has its center 14 aligned with the center 15 of the clubhead. The prongs 12*a* and 12*b* are connected to the clubhead behind the striking face 13*a*.

By having the angle of the prong 12*a* from the toe at about 45° and by having the angle of prong 12*b* at about 15° there is created a triangle that intercepts about three inches above the sole of the putter where the shaft 11 connects to the clubhead 13.

The balancing provided by the present connective concept can be adapted to any style putter that has the traditional single connection. A correct balance of the putter is provided so that there is eliminated all of the twisting and turning during a golf stroke. The instant putter also eliminates vibrations.

By having prongs 12*a* and 12*b* connected to the clubhead behind the striking face 13*a*, there is created a putter where the weight is toward the face 13*a*. The putter is then balanced downward instead of upward so as to allow the player to follow through the ball towards the hole and create a smoother putt with a restrictive follow through.

Figure 1:
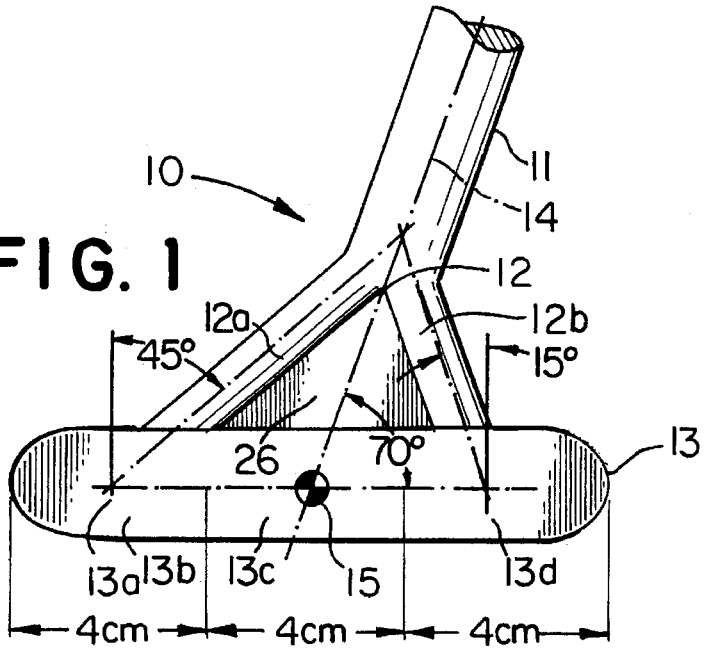
FIG. 1 is a front view illustrating a preferred embodiment of the present invention.
Figure 2:
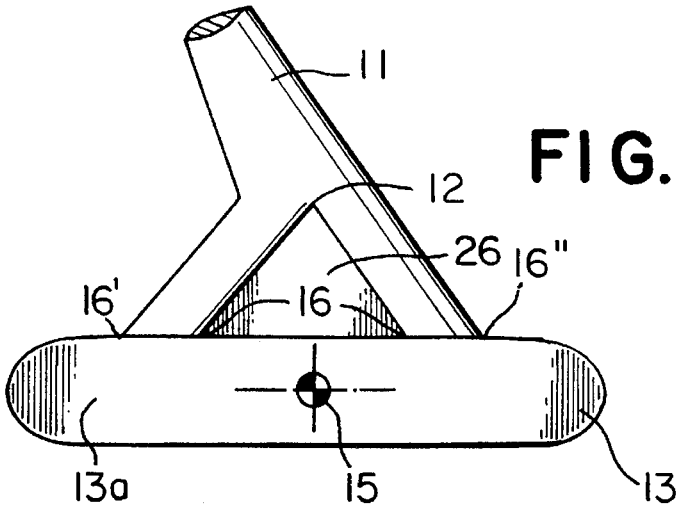
FIG. 2 is a rear view of the golf putter of FIG. 1.
Figure 3:
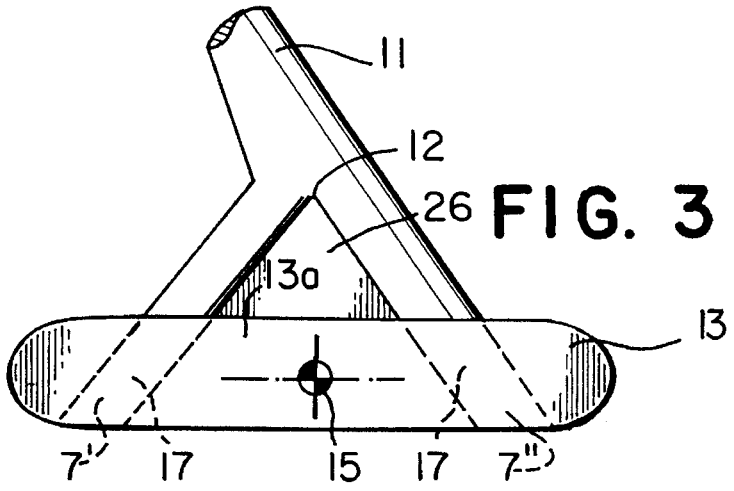
FIG. 3 is a rear view of another embodiment of the invention.

As illustrated in FIGS. 2 and 3, rear views of the invention, the two legs of the inverted V-shaped member 12 may be affixed to the top 16' and 16" of the clubhead 13 at each side, as shown in FIG. 2, or they may be extended through bored out holes 17' and 17" on each side of the head and bonded together with epoxy, as shown in FIG. 3. A metallic or plastic insert is bonded between the two legs of the V-shaped member. The angles and spacing of the two legs is as described for FIG. 1.

Figure 4:
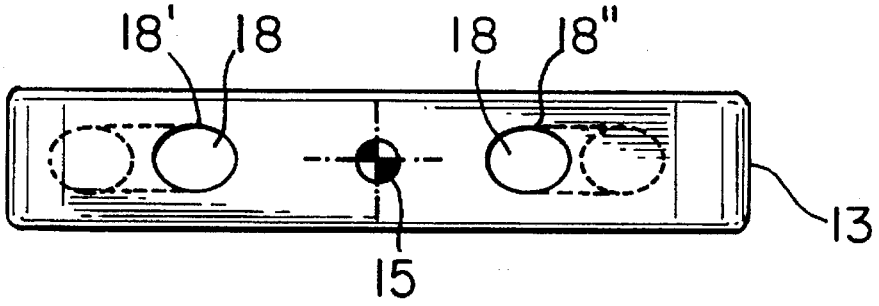
FIG. 4 is an top view of the golf club of FIG. 1.

As shown in FIG. 4, a top view of the invention, the shaft 11 connects to the clubhead 13 by the V-shaped member 12 at points 18' and 18" on the head 13 in a symmetrical fashion such that the amount of space moving horizontally from the center 15 of the club face 13*a* toward each end of the V-shaped member shaft 11 is equidistant from the center point 15.

Figure 5:
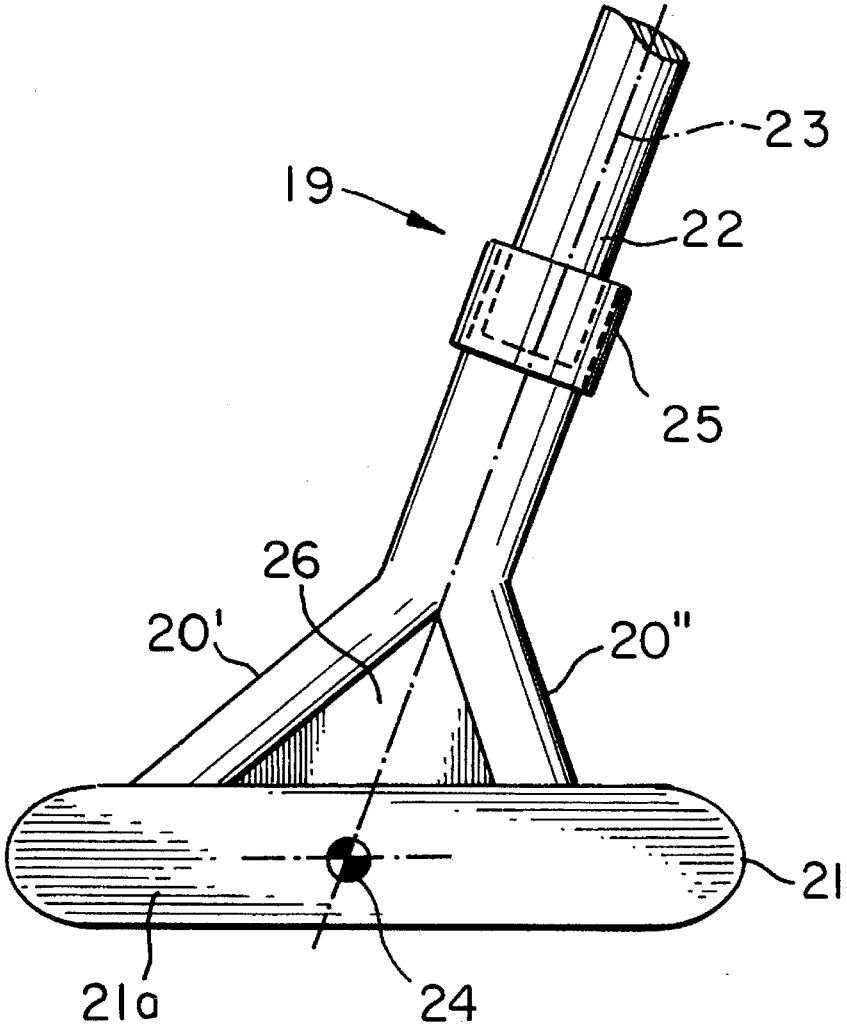
FIG. 5 is a front view illustrating another embodiment of the present invention.

In FIG. 5, a front view of a putter 19 of the invention, another embodiment of the invention is illustrated. The two legs of the inverted V-shaped member 20' and 20" are constructed as part of the club head 21, rather than as part of the shaft 22. The center of the shaft 23 is longitudinally in line with the center 24 of the club face 21*a*. In a preferred embodiment of the invention, the shaft 22 is connected to the modified head 20', 20" and 21 at a joint 25 above the apex of the inverted V-shaped member. The putter is balanced as described in FIG. 1.

While the invention as illustrated depicts a golf putter, it is not limited to such, and in fact, it is contemplated that the invention is equally applicable to golf drivers and fairway clubs.

As various changes may be made in the form, arrangement and construction of parts of the preferred embodiments without departing from the spirit of the invention, it is understood that all matters herein are to be taken as illustrative and not in a limiting sense.

What is claimed:

1. A golf club comprising:

a) a shaft having at one end two prongs forming an inverted V-shaped member;

b) a wall between said prongs; and c) a head having a striking face, said shaft being affixed to said head through said V-shaped member so that the center of the shaft is longitudinally in line with the longitudinal center of the striking face and the prongs are behind a plane containing said striking face, said clubhead having a toe portion, a center portion and a heel portion, one of said prongs being connected to the clubhead along the longitudinal center of the toe portion, the other of said prongs being connected along the longitudinal center of said heel portion and the shaft having its longitudinal center aligned with the center of the center portion whereby the weight of the clubhead is toward the striking face and the clubhead is balanced.

2. The golf club of claim 1 wherein said shaft has a top and is affixed to the top of said head.

3. The golf club of claim 1 wherein said head has a plurality of bores and said shaft is affixed to said head through said V-shaped member to said bores.

4. The club of claim 1 wherein said shaft is affixed to said head in a symmetrical fashion such that the amount of space moving horizontally from the longitudinal center of the striking face toward each end of the V-shaped member is equidistant from the center and is at an angle of about 70 degrees of a line running horizontally through the center of the striking face.

5. The golf club of claim 4 wherein the toe portion, center portion and heel portion are equally segmented along the striking face.

6. The golf club of claim 5 wherein each portion is about 4 cm in length along a horizontal line.

7. The golf club of claim 1 wherein the prong connected at the toe portion has a slope of about 45 degrees with respect to a vertical line oriented perpendicular to the longitudinal axis of the clubhead.

8. The golf club of claim 1 wherein the prong connected at the heel portion has a slope of about 15 degrees with respect to a vertical line oriented perpendicular to the longitudinal axis of the clubhead.

9. A golf putter comprising:

a) a shaft having at one end two prongs forming an inverted V-shaped member and a wall between said prongs;

b) a head having a striking face connected to said prongs, said prongs connected behind a plane containing said striking face, the striking face having a toe portion, a center portion and a heel portion, one of said prongs being connected at a top of the head along the longitudinal center of the toe portion and the other prong being connected at said top of the head along the longitudinal center of the heel portion, and said shaft having its longitudinal center aligned with the center of the center portion whereby the weight of the clubhead is toward the striking face and the clubhead is balanced.

10. The putter of claim 9 wherein said wall is metallic and integral with said prongs.

11. The putter of claim 9 wherein said prongs are equidistant from the longitudinal center of said clubhead.

12. The putter of claim 9 wherein the prong connected at the toe portion has a slope about 45 degrees with respect to a vertical line oriented perpendicular to the longitudinal axis of the clubhead.

* * * * *